US008157119B2

(12) United States Patent
Watson et al.

(10) Patent No.: US 8,157,119 B2
(45) Date of Patent: Apr. 17, 2012

(54) CAN END

(75) Inventors: Martin J. Watson, Wantage (GB); Brian Fields, Lemont, IL (US); Andrew Robert Lockley, Wantage (GB)

(73) Assignee: Crown Packaging Technology, Inc., Alsip, IL (US)

( * ) Notice: Subject to any disclaimer, the term of this patent is extended or adjusted under 35 U.S.C. 154(b) by 0 days.

(21) Appl. No.: 12/551,907

(22) Filed: Sep. 1, 2009

(65) Prior Publication Data

US 2010/0044383 A1 Feb. 25, 2010

Related U.S. Application Data

(63) Continuation of application No. 10/979,068, filed on Nov. 1, 2004, now Pat. No. 7,591,392, which is a continuation-in-part of application No. 10/770,791, filed on Feb. 3, 2004, now abandoned, which is a continuation of application No. PCT/EP03/03716, filed on Apr. 10, 2003.

(30) Foreign Application Priority Data

Apr. 22, 2002 (EP) ..... 02252800

(51) Int. Cl.
*B65D 6/28* (2006.01)
*B65D 8/04* (2006.01)
*B65D 8/06* (2006.01)

(52) U.S. Cl. ..... 220/619; 220/624; 220/906

(58) Field of Classification Search ..... 220/615, 220/618–620, 623, 624, 906
See application file for complete search history.

(56) References Cited

U.S. PATENT DOCUMENTS

| | | | | |
|---|---|---|---|---|
| 3,441,170 | A | 4/1969 | Khoury | |
| 3,843,014 | A | 10/1974 | Cospen et al. | |
| 4,434,641 | A * | 3/1984 | Nguyen | 72/313 |
| 4,577,774 | A * | 3/1986 | Nguyen | 220/623 |
| 4,796,772 | A | 1/1989 | Nguyen | |
| 4,808,052 | A | 2/1989 | Bulso, Jr. et al. | |
| 4,832,223 | A | 5/1989 | Kalenak et al. | |
| 4,928,844 | A | 5/1990 | LaBarge | |
| 5,645,189 | A | 7/1997 | Clowes | |
| 5,829,623 | A | 11/1998 | Otsuka et al. | |
| 5,950,858 | A | 9/1999 | Sergeant | |
| 6,065,634 | A | 5/2000 | Brifcani et al. | |
| 6,089,072 | A | 7/2000 | Fields | |

(Continued)

FOREIGN PATENT DOCUMENTS

EP 0 303 837 A2 2/1989

(Continued)

*Primary Examiner* — Harry Grosso
(74) *Attorney, Agent, or Firm* — Woodcock Washburn LLP

(57) ABSTRACT

A can end having a countersink bead, an inclined chuck wall and a strong seam, resists distortion from its circular profile when subjected to thermal processing or when packaging carbonated beverages. This high hoop strength affects the manner in which the can end ultimately fails when placed under extreme abuse conditions, even if buckle pressure performance is within industry specified standards. The can end of the invention has control features introduced which control the failure mode whilst maintaining specified buckle pressure performance. In one embodiment, the can end has a two part wall and a control feature that comprises expansion of the countersink bead to act as a trigger for local peaking, together with a groove in the chuck wall which prevents the peaking force from being concentrated at a single point which could result in leaking by the production of a pin hole.

11 Claims, 7 Drawing Sheets

U.S. PATENT DOCUMENTS

| | | | |
|---|---|---|---|
| 6,102,243 | A | 8/2000 | Fields et al. |
| 6,158,608 | A | 12/2000 | Schlattl |
| D452,155 | S | 12/2001 | Stodd |
| 6,370,818 | B1 | 4/2002 | Chabot et al. |
| 6,419,110 | B1 | 7/2002 | Stodd |
| 6,460,723 | B2 | 10/2002 | Nguyen et al. |
| 6,499,622 | B1 | 12/2002 | Neiner |
| 6,516,968 | B2 | 2/2003 | Stodd |
| D471,453 | S | 3/2003 | Stodd |
| 6,561,004 | B1 | 5/2003 | Neiner et al. |
| D480,304 | S | 10/2003 | Stodd |
| 6,702,142 | B2 | 3/2004 | Neiner |
| 6,736,283 | B1 | 5/2004 | SantaMaria et al. |
| 6,772,900 | B2 | 8/2004 | Turner et al. |
| 7,370,774 | B2 | 5/2008 | Watson |
| 7,591,392 | B2 | 9/2009 | Watson |
| 2002/0134788 | A1 | 9/2002 | Nguyen |
| 2003/0010785 | A1 | 1/2003 | Stodd |
| 2003/0042258 | A1 | 3/2003 | Turner et al. |
| 2003/0121920 | A1 | 7/2003 | Zonker et al. |
| 2003/0173367 | A1 | 9/2003 | Nguyen et al. |
| 2004/0074911 | A1 | 4/2004 | Stodd |
| 2004/0094559 | A1 | 5/2004 | SantaMaria et al. |
| 2004/0159697 | A1 | 8/2004 | Turner et al. |
| 2004/0238546 | A1 | 12/2004 | Watson |

FOREIGN PATENT DOCUMENTS

| | | | |
|---|---|---|---|
| EP | 0 828 663 | B1 | 12/1999 |
| EP | 1 105 232 | | 5/2002 |
| EP | 1 361 164 | | 12/2003 |
| JP | 5112357 | A | 7/1993 |
| JP | 2003136168 | | 5/2003 |
| WO | WO 98/34743 | | 8/1998 |
| WO | WO 99/24326 | | 5/1999 |
| WO | WO 02/43895 | | 6/2002 |
| WO | WO 03/035494 | A1 | 5/2003 |
| WO | WO 03/059764 | | 7/2003 |

* cited by examiner

FIG. 3
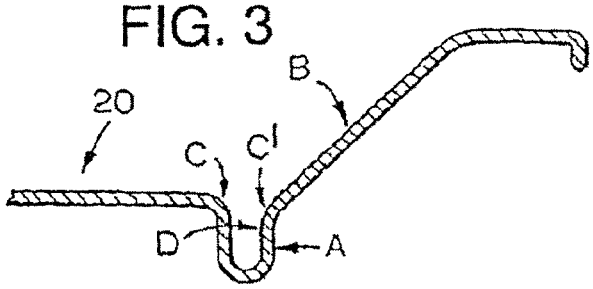
FIG. 4A
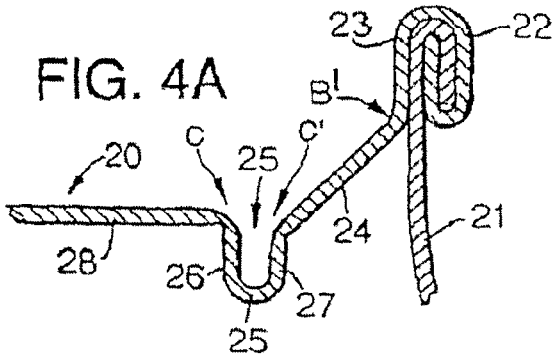
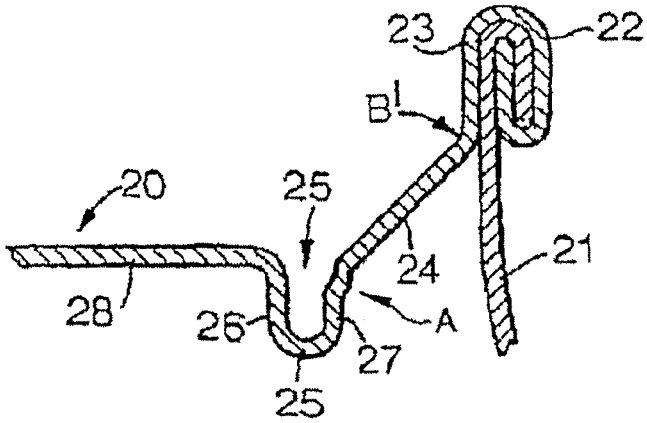
FIG. 4B

CAN END

This is a continuation of U.S. patent application Ser. No. 10/979,068, filed Nov. 1, 2004, which is a continuation-in-part of U.S. patent application Ser. No. 10/770,791, filed Feb. 3, 2004, which is a continuation of PCT/EP03/03716 filed Apr. 10, 2003, which claims priority to EPO Application Number 02252800.4 filed Apr. 22, 2002.

BACKGROUND OF THE INVENTION

This invention relates to a can end and a method of manufacture of such a can end. In particular, it relates to a can end which has improved performance characteristics.

Containers such as cans which are used for the packaging beverages, for example, may contain a carbonated beverage which is at a higher than atmospheric pressure. Can end design has been developed to withstand this "positive" buckle pressure (sometimes also referred to as "peaking" pressure) up to defined minimum values (currently 90 psi for carbonated soft drinks) under normal operating conditions before failure. About 8 to 10 psi above this value, failure of conventional can ends involves loss of the circular profile and buckling of the end which, ultimately, leads to eversion of the end profile. Abuse conditions may also arise when a container is dropped or distorted, or when the product within the container undergoes thermal processing.

One solution to the problem of loss of circular profile is provided by the can end which is described in our U.S. Pat. No. 6,065,634. The can end shell (that is, the unseamed can end) of that patent includes a peripheral curl, a seaming panel, a chuck wall at an angle of between 30° and 60°, a narrow anti-peaking bead and a center panel. During seaming of the shell to the can body, the chuck wall is deformed at its upper end by contact with an anvil portion of the seaming chuck. The resulting profile provides a very strong double seam since the annulus formed by the seam has very high hoop strength and will resist distortion from its circular profile when subjected to thermal processing or when packaging carbonated beverages.

Stiffness is also provided to the beverage can end by the anti-peaking or countersink bead. This is an outwardly concave bead comprising inner and outer walls, joined by a curved portion. In the '634 patent this bead has walls which are substantially upright, although either may vary by up to +/−15°. This patent uses a small base radius (best fit) for the bead, typically 0.75 mm or less.

It is known from U.S. Pat. No. 6,089,072 that the width of the anti-peaking bead can be reduced by free drawing of the inner wall of the bead. This latter method avoids undue thinning of the bead as it is reworked. The resultant narrower bead optimises the stiffness of the can and, consequently, its resistance to buckling when attached to a can body having high internal pressure in the can.

Can ends such as those described in the above patents have high hoop strength and/or improved buckle performance such that they resist deformation when subjected to high internal pressure. In particular, the buckle pressure of the end of the '634 patent is well above the 90 psi can making industry minimum standard.

Whilst high hoop strength is predominantly beneficial it will affect the manner in which the can end ultimately fails. In a conventional can end, the circular periphery of the can end will tend to distort and become oval under high internal pressure. If the circular shape of the seamed end is free to distort to an oval shape under high internal pressure, as is usual, then part of the anti-peaking bead will open out along an arc at one end of the long axis of the oval shape as the can end everts locally.

However, as the inventors have observed in the can end of the '634 patent in particular, it has been found that the stiff annulus formed by the double seam resists such distortion. As a result, when subjected to severe abuse conditions, dropping during transport, mishandling by machinery, freezing etc, it has been found that the resultant failure mode may lead to leakage of can contents. When distortion of the seam or anti-peaking bead is resisted by a strong seam and/or anti-peaking bead, failure can be by eversion of the bead at a single point rather than along an arc. Such point eversion leads to pin hole leaks or even splitting of the can end due to the localised fatiguing of the metal and extreme conditions may even be explosive

SUMMARY OF THE INVENTION

This invention seeks to control the failure mode and to avoid catastrophic failure and leaking, whilst still achieving buckle pressure performance well above the industry stipulated pressure of 90 psi.

According to the present invention, there is provided a can end shell comprising a center panel, a countersink bead, an inclined chuck wall portion, and a seaming panel, and further including one or more control features, each feature extending around an arc of part of the countersink bead and/or the chuck wall whereby the failure mode of the can end, when seamed to a can body, is controlled, and in which the or each control feature comprises one or more of: an expansion of the countersink bead, a shelf in the outer wall of the countersink, an indentation in the chuck wall, and/or coining.

For the avoidance of doubt, it should be noted that the term "arc" as used herein is intended to include a 360° arc, i.e. a control feature or features which extend around the whole circumference of the can end shell. Furthermore, it should be noted that the term "inclined" is not intended to be limiting and the inclined chuck wall may have one or more parts, any of which may be linear or curved, for example.

A control feature, such as a selectively weakened region, may be introduced onto the can end in a variety of different ways, all of which are intended to limit or prevent the concentration of strain. Control features or weakenings may be achieved by increasing the radial position of the outer wall of the countersink bead, a shelf in the countersink bead, an indentation in the chuck wall, or coining. Numerous variations are possible within the scope of the invention, including those set out below.

Usually, a shelf in the countersink bead will be in the outer wall of the bead, and may be at any position up that wall. Clearly when the shelf is at the lower end of the outer wall it effectively corresponds to an expansion in the bead radius. A shelf or groove may be provided on any part of a radial cross-section through the bead but as the inner wall diameter position is often used as a reference for machine handling purposes and the thickness of the base of the countersink should ideally not be reduced, the outer wall is the preferred location.

Preferably, an indentation in the chuck wall should be made so that in the seamed can end, the indentation is positioned approximately at the root of the seam. In the end shell this means that the indentation should be made about half way up the chuck wall or in the upper half of the chuck wall, depending on the type of seam. The indentation may be made using radial and indent spacers to control the radial and penetration depth of the tool.

In one embodiment, a control feature may extend over a single arc behind the heel of the tab, centered on a diameter through the tab rivet and nose. Alternatively, there may be a pair of control features, symmetrically placed one on either side of the tab, and ideally centered at +/−90° or less from the heel (handle end) of the tab. In this embodiment, the arc length may be anything up to 90° in order to encompass any "thin point" due to orientation relative to grain orientation.

A control feature may comprise a combination of different types of control features, usually over at least a portion of the same arc of the can end such that, where the arcs are not fully circumferential, the different types are centered on the same can end diameter. For example, there may be an expansion of the bead wall/radius and an indentation in the chuck wall for the same or each control feature. In this example, the indentation in the chuck wall may extend over the same length of arc as the bead expansion, a longer or a shorter arc length, with the centers of the arcs being on the same end diameter. In yet another embodiment, there may additionally be a shelf-type groove, as well as the bead expansion and chuck wall indentation.

The countersink bead may have its base radius enlarged and then incorporate a control feature comprising a shelf in its outer wall. In one example, the arc length of the bead expansion (and, where present, the shelf) is less than the arc length of the chuck wall indentation, such that the bead expansion (and shelf) acts as a trigger for local peaking.

Where the control feature comprises an indentation or coined region on the chuck wall, this may extend either internally or externally, or a combination of these around the arc. For the purpose of this description, it is the side of the can end to which a tab is fixed which is referred to as "external" as this side will be external in the finished can. Preferably, however, the indentation extends inwardly as otherwise it may be removed by the seaming tool during seaming.

In a further embodiment, the end shell may additionally include coining of a shoulder between the inner wall of the countersink and the center panel over an arc or pair of arcs.

The control feature is preferably made in a conversion press but it may be made in a shell press or even in a combination of the shell and conversion presses providing that orientation of the end is not an issue.

Whilst the terms "groove", "indentation" and "indent" have been used above, it should be appreciated that these terms also encompass any reshaping of the can end to form a control feature, including the use of a point indent or series of indents and other variations of points and grooves.

According to another embodiment, a can end shell and seamed can end are provided having an increased wall angle that forms a control feature or weakening. The unseamed end includes a circumferentially extending peripheral curl including a cover hook, a seaming panel, and a radiused portion; a wall extending circumferentially and radially inward from said radiused portion of said peripheral curl at a first point; an annular reinforcing bead extending radially inward from said wall at a second point, wherein a line between said first and second points is inclined between about 30° and about 60° with respect to an axial centerline of said can end; a center panel; and one or more control features, each control feature extending around an arc of at least part of the countersink bead and/or the chuck wall, whereby the failure mode of the can end, when seamed to a can body, is controlled, and in which the or each control feature comprises one or more of: an expansion of the countersink bead, a shelf in the outer wall of the countersink, an indentation in the chuck wall, and/or coining.

The wall comprises an upper wall portion and a lower wall portion and a juncture therebetween, said upper wall portion extending inwardly from said first point, said lower wall portion extending radially outwardly from said second point. The lower wall portion preferably is inclined greater than 46°, preferably between 46° and 60°, more preferably between 46° and 54°, more preferably between 48° and 54°, and most preferably about 52°.

The can end shell may also be formed with the above inclined wall without other control feature or weakening. Such seamed can end includes a circumferentially extending peripheral curl including a cover hook, a seaming panel, and a radiused portion; an annular reinforcing bead extending radially inward from said wall lower portion at a second point, wherein a line between said first and second points is inclined between about 20° and about 60° with respect to the axial centerline; a center panel; and a wall extending circumferentially and radially inwardly from said radiused portion of said peripheral curl at a first point and extending circumferentially and radially outwardly from the bead at a second point; said wall including a lower portion, an upper portion, and a juncture therebetween, said lower wall portion being inclined between 46° and 60° with respect to an axial centerline of said can end and measured between said second point and said juncture. The lower wall portion preferably is inclined between 46° and 54°, more preferably, between 48° and 54°, even more preferably at approximately 52°. The seamed can end having a wall inclined at the above angles.

BRIEF DESCRIPTION OF THE FIGURES

Preferred embodiments of the invention will now be described, by way of example only, with reference to the drawings, in which:

FIG. 3 is a partial side section of the can end of FIG. 2A, prior to seaming;

FIG. 4A is a partial side section of the can end of FIG. 2A, after seaming to a can body, illustrating control features;

FIG. 4B is a partial side section of the can end of FIG. 2A, after seaming to a can body, illustrating other control features;

DETAILED DESCRIPTION OF PREFERRED EMBODIMENTS

Figure 1:
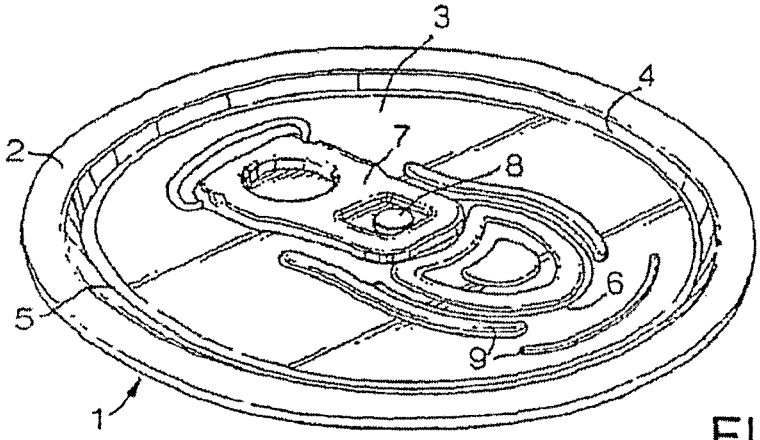
FIG. 1 is a perspective view of a conventional beverage can end.

The can end of FIG. 1 is a conventional beverage end shell 1 comprising a peripheral curl 2 which is connected to a center panel 3 via a chuck wall 4 and anti-peaking reinforcing bead or countersink 5. The center panel has a score line 6 which defines an aperture for dispensing beverage. A tab 7 is fixed to the center panel 3 by a rivet 8, as is usual practice. Beads 9 are provided for stiffening the panel.

The can end of FIG. 1 when attached by seaming to a can body which is filled with carbonated beverage, for example, is typically able to withstand an internal pressure of 98 psi before buckling, 8 psi above the required minimum buckle pressure of 90 psi. When the pressure approaches and exceeds this value, the circular shape of the periphery of the end will distort and become oval. Eventually the center panel will be forced outwardly so that the countersink "unravels" and flips over an arc of its circumference. Whilst a can which is buckled in such a manner is unlikely to be acceptable to a consumer, the can end itself is still intact, the tab 7 is still accessible and there is no compromise to the sealing of the container by such failure which could result in leaking of the contents.

It has been found by the present Applicant, however, that where a container has an end which is, by virtue of its design, substantially stiffer and has greater hoop strength than that of FIG. 1, the buckle failure mode differs from that described above. Such a can end is that of the '634 patent, the general shape of which is shown for reference in FIGS. 2A to 4B. The can end 20 is attached to a can body 21 by a double seam 22, as shown in FIGS. 4A and 4B. Inner portion 23 of the seam 22, which is substantially upright, is connected to a countersink bead 25 by a chuck wall 24. The countersink, or anti-peaking bead 25 has inner and outer walls 26 and 27, the inner wall 26 depending from the centre panel 28 of the end.

Whilst the higher hoop strength exhibited by this can end is of great importance in maintaining the overall integrity of the container, the mode in which the can fails under severe abuse conditions may be unacceptable and even, on occasion, catastrophic. Typical failure modes may compromise the integrity of the can by pin hole(s) and/or splitting of the can end. In extreme cases, the center panel 28 is pushed outwardly by excessive internal pressure. As the panel moves outwardly, it pulls the inner wall 26 of the anti-peaking bead 25 with it. The inner portion 23 of seam 22 is "peeled" away from the rest of the seam as the can end is forced out. The explosive nature of this so-called "peaking" failure results in the formation of a bird's beak configuration with a pin hole at the apex of the "beak" where the force is concentrated in a single point at the base of the countersink 25.

The Applicants have discovered that by providing the can end with a control feature, a preferential "soft" peak is obtainable when the can end fails. Although this means that the can end may fail at a lower buckle pressure, the softer, less explosive nature of the peak results in a failure mode without pin hole or tearing. The introduction of a control feature thus controls the failure mode and avoids concentration of the forces at a single point.

Control features in accordance with the invention can take a variety of forms including, without limitation, one or more of the following with reference to FIGS. 3, 4A, and 4B:

A. The radial position of the outer wall 27 of the countersink bead may be increased;

B. The chuck wall 24 may be coined or have indentations at or above approximately the mid-point such that this control feature is at the root of the seam 22 in the seamed can end (denoted as B');

C. Coining of the inner shoulder (C) of the countersink or of the outer shoulder (C');

D. A shelf may be made in the outer wall 27 of the countersink bead.

Figure 2A:
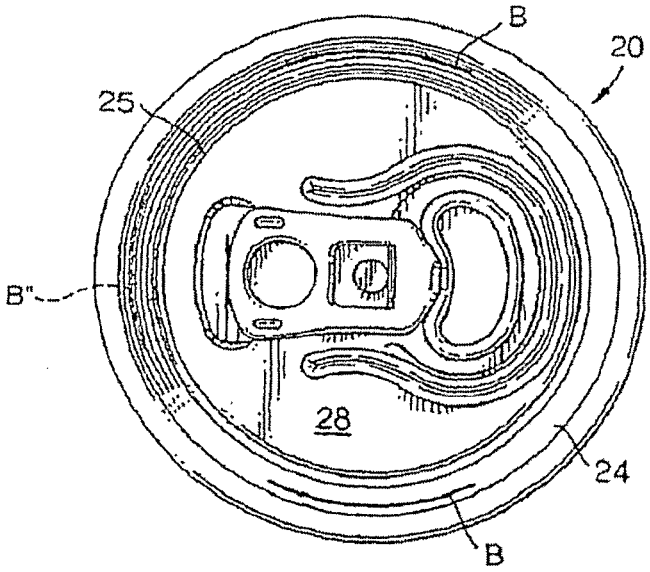
FIG. 2A is a plan view of another type of beverage can end schematically illustrating a 360 degree control feature.
Figure 2B:
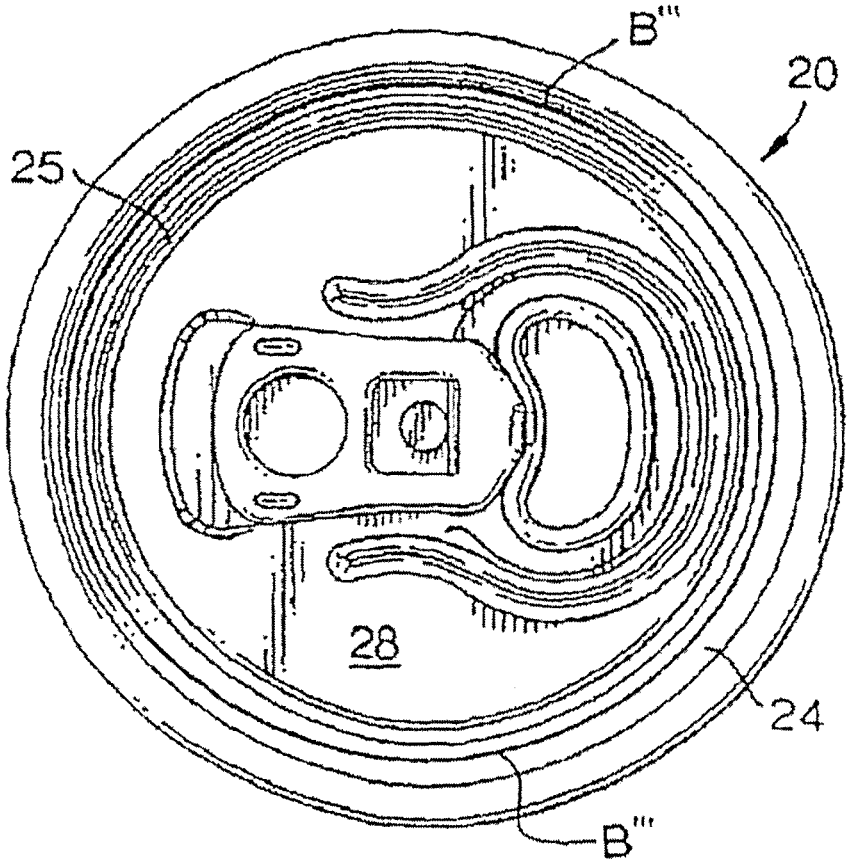
FIG. 2B is a plan view of the type of beverage can shown in FIG. 2A and schematically illustrating a 360 degree control feature.
Figure 5:
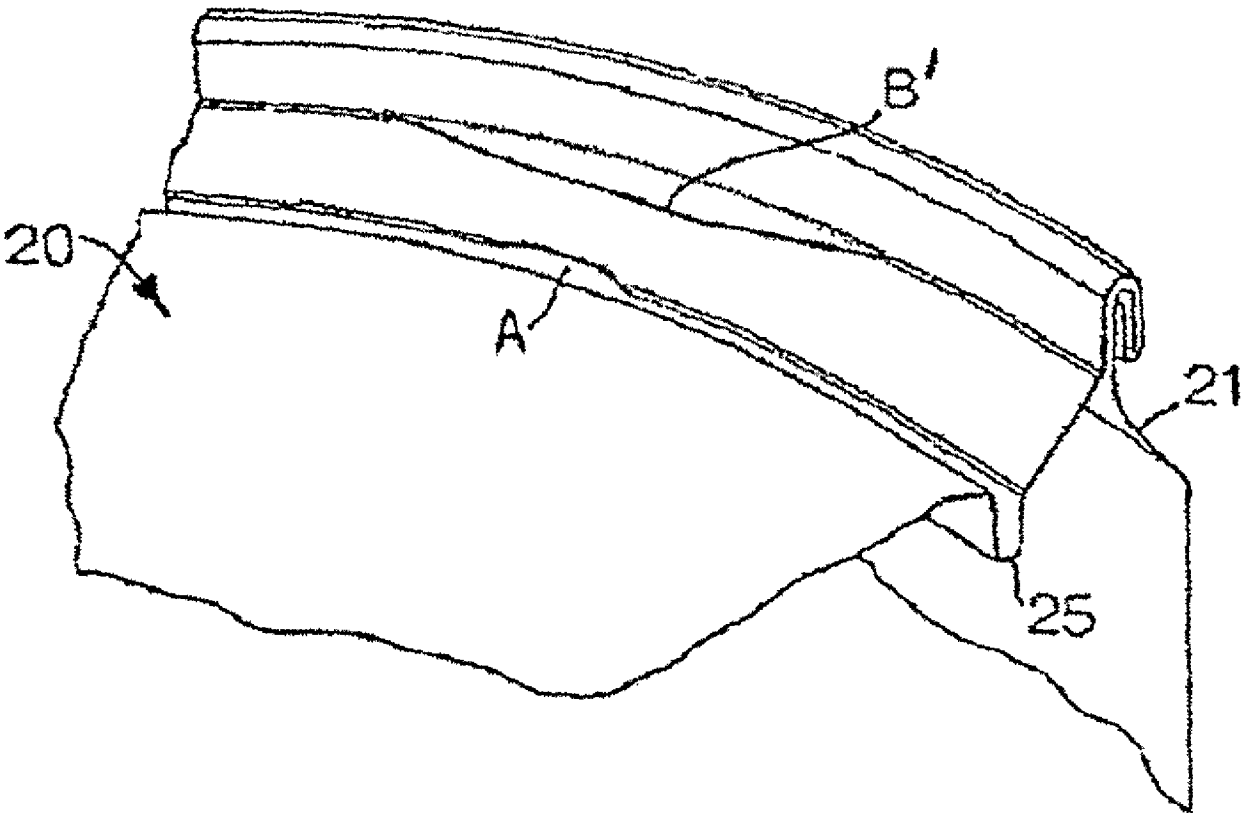
FIG. 5 is a sectioned perspective view of a seamed can end having two types of control features.

FIG. 2A schematically shows control feature B located on each side of the diameter through a central axis of tab 7 and extending around an arc. FIG. 2A also schematically shows a control feature, identified by the reference B" and shown in dashed lines, located behind the heel of tab 7 in an arc that is centered on a diameter through the tab central axis. FIG. 2B schematically illustrates a control feature, identified as reference B'", extending 360 degrees around the end. FIG. 4A schematically shows coining C of a shoulder between countersink inner wall 26 and center panel 28, and coining C' located on the shoulder between countersink outer wall 27 and chuck wall 24. FIG. 4B schematically illustrates a shelf in countersink outer wall 27.

When a type D region is at the lower part of the outer countersink wall, this may be equivalent to a type A control feature. Higher up the outer wall, a type D region takes the clear form of a shelf.

In a preliminary trial of the present invention, the shell having an overall shape shown in FIGS. 2A and 3 was modified by a local groove in the outer wall of the countersink. This groove was ideally adjacent the handle of the tab so that any failure of the can end would be away from the score. Positioning either side of the tab or, indeed, at any position around the countersink was also considered possible. The groove was typically about 8 mm in arc length and was positioned approximately half way down the outer wall of the countersink bead, in the form of a shelf. Computer modelling has showed that the provision of such a groove resulted in a failure mode similar to that of a conventional can end such as that of FIG. 1, with no leakage.

Modelling and bench testing has revealed that even better control of the failure mode was achievable when a pair of grooves were made at the base of the countersink outer wall. A variety of variables were modelled and then bench tested as follows:

| | |
|---|---|
| depth of groove | bottom of outer wall * |
| gap between grooves | 3 mm to 6 mm |
| radial interference (depth of penetration into outer wall) | 0.2 mm to 0.4 mm |
| orientation | behind (handle end of) tab<br>60° to tab left only<br>60° to tab right only<br>60° to tab left and right |

* This is equivalent to increasing the radial position of the countersink (anti-peaking) bead.

In bench testing of a small batch of cans using each of the above combinations, it was found that whilst the majority of cans leaked, the provision of a control feature controlled the position of peaking to the indentation site and all leaks were located on the peaks rather than on the tab rivet or score.

In spite of the fact that the cans of the initial trial still leaked on peaking, the Application discovered that the incident of leakage was greatly reduced by a combination of types of control features which may, individually, exhibit unacceptable leaking on peaking. The following examples show how the failure mode can not only be focussed on a particular site on the can end but also be controlled such that the can also has acceptable buckle performance. In all of these further trials, cans were heated to 100° F. before carrying out the drop tests.

EXAMPLE 1

Can ends were modified in the conversion press by expanding the countersink bead over a 60° arc at positions +/−90° of the tab heel. These ends were then seamed onto filled cans and dropped vertically, tab end down, onto a steel plate, the sheet steel being inclined at 30°. This extreme test is non-standard and tested the cans for severe abuse performance. The tests used the Bruceton staircase analysis and results are set out in table 1, where P=standard peak and PS=peak and score burst.

All cans tested peaked at the control feature without splitting. As with preliminary bench testing, the position of peaking was focussed on the indentation site.

Can ends modified in this way were also tested by pressurising a can to which the end was seamed ("seamed end test"). These results are shown in table 2. Whilst the cans all peaked on the indentation site and were still openable after peaking, only 25% survived testing without leaking on the peak location.

TABLE 1

(Bruceton staircase test)
Expanded countersink bead
Drop test (onto 30° sheet steel)

| CAN | HEIGHT (") | LEAK ON PEAK? | PEAK ON CONTROL FEATURE? | PEAK TYPE |
|---|---|---|---|---|
| 1 | 5 | N | Y | P |
| 2 | 10 | N | Y | PS |
| 3 | 5 | N | Y | P |
| 4 | 10 | N | Y | P |
| 5 | 15 | N | Y | PS |
| 6 | 10 | N | Y | PS |
| 7 | 5 | N | Y | P |
| 8 | 6 | N | Y | P |
| 9 | 7 | N | Y | P |
| 10 | 8 | N | Y | PS |
| 11 | 7 | N | Y | P |
| 12 | 8 | N | Y | PS |
| 13 | 7 | N | Y | P |
| 14 | 8 | N | Y | PS |
| 15 | 7 | N | Y | P |

TABLE 2

(SET test)

| CAN | PRESSURE (psi) | SURVIVE? | PEAK ON CONTROL FEATURE? | OPENABLE? |
|---|---|---|---|---|
| 1 | 95 | N | Y | Y |
| 2 | 93.4 | Y | Y | Y |
| 3 | 99.3 | N | Y | Y |
| 4 | 100.4 | N | Y | Y |
| Average | 97.0 | 25% | 100% | 100% |

P = standard peak with no leak
PS = peaked and burst at the score

EXAMPLE 2

Further can ends were then modified in the conversion press both by expanding the countersink bead over a 60° arc at positions +/−90° of the tab heel, and also by providing a indentation over a 50° arc at positions +/−90° in the upper chuck wall. These ends were then seamed onto filled cans and drop tested by dropping vertically, tab end down, onto a steel plate, the sheet steel being inclined at 30°. The results of the second tests are given in table 3, where again P=standard peak and PS=peak and score burst.

The combination of a countersink bead expansion and indentation in the chuck wall increases the average height at which peaking occurs. The countersink bead expansion was found to act as a trigger and this combination of a trigger and chuck wall indentation controls the peaking better than a countersink bead expansion alone (example 1).

Can ends modified in this way were also tested by pressurising a can to which the end was seamed ("seamed end test"). These results are shown in table 4.

In the results of table 4, all the cans again peaked on the indentation site and were still openable after peaking. In addition, 100% survived testing without leaking on the peak location, supporting the Applicant's discovery that by combining two types of control feature, performance in terms of leak-free failure mode is dramatically improved.

TABLE 3

(Bruceton staircase test)
Expanded countersink bead + chuck wall groove
Drop test (onto 30° sheet steel)

| CAN | HEIGHT (") | LEAK ON PEAK? | ON CONTROL FEATURE? | PEAK TYPE |
|---|---|---|---|---|
| 1 | 5 | N | Y | P |
| 2 | 10 | N | Y | P |
| 3 | 15 | Y | Y | P |
| 4 | 12 | Y | Y | P |
| 5 | 11 | N | Y | P |
| 6 | 12 | Y | Y | P |
| 7 | 11 | N | Y | P |
| 8 | 12 | Y | Y | P |
| 9 | 11 | N | Y | P |
| 10 | 10 | Y | Y | P |
| 11 | 8 | N | Y | PS |
| 12 | 9 | Y | Y | P |
| 13 | 8 | N | Y | P |
| 14 | 9 | Y | Y | P |
| 15 | 8 | N | Y | P |

TABLE 4

(SET test)

| CAN | PRESSURE (psi) | SURVIVE? | PEAK ON CONTROL FEATURE? | OPENABLE? |
|---|---|---|---|---|
| 1 | 93.7 | Y | Y | Y |
| 2 | 87 | Y | Y | Y |
| 3 | 93.2 | Y | Y | Y |
| 4 | 92.3 | Y | Y | Y |
| Average | 91.6 | 100% | 100% | 100% |

EXAMPLE 3

Can ends having an indentation in the upper chuck wall only (i.e. not in the countersink) were seamed to can bodies and then pressurised. Runs 1 to 8 had a single indentation behind the tab over an arc of about 40° to 50°. Runs 1-1 to 8-8 had indentations at +/−90° and over a 50° arc. Mean results are given throughout. Peak location indicates the incidence of a peak on the control feature. The spacer details explain the degree of indentation in the chuck wall.

TABLE 5

(SET test)

| RUN | Reversal pressure (psi) | % peak on control feature | Survival | Openable | Radial spacer (mm) | Indent spacer |
|---|---|---|---|---|---|---|
| 1 | 99.03 | 100% | 25% | 100% | 0.5 | 8.75 |
| 2 | 101.7 | 75% | 50% | 100% | 0 | 8.75 |
| 3 | 92.48 | 100% | 75% | 75% | 0 | 9.25 |
| 4 | 91.3 | 100% | 25% | 75% | 0.5 | 9.25 |
| 5 | 101.83 | 100% | 75% | 100% | 0.5 | 10.75 |
| 6 | 103.2 | 100% | 100% | 100% | 0 | 10.75 |
| 7 | 94.65 | 100% | 50% | 100% | 0 | 11.25 |
| 8 | 93.45 | 100% | 75% | 100% | 0.5 | 11.25 |
| 1-1 | 101.45 | 100% | 75% | 75% | 0.5 | 8.75 |
| 2-2 | 101.83 | 75% | 75% | 100% | 0 | 8.75 |
| 3-3 | 92.35 | 100% | 75% | 100% | 0 | 9.25 |
| 4-4 | 89.6 | 100% | 25% | 100% | 0.5 | 9.25 |
| 5-5 | 102.0 | 100% | 75% | 100% | 0.5 | 10.75 |
| 6-6 | 103.95 | 75% | 50% | 100% | 0 | 10.75 |
| 7-7 | 94.98 | 100% | 75% | 100% | 0 | 11.25 |
| 8-8 | 95.8 | 100% | 75% | 100% | 0.5 | 11.25 |
| CONTROL | 105.98 | N/A | 25% | 100% | N/A | N/A |

EXAMPLE 4

Further trials were conducted to confirm the effect of expansion of the countersink radius and the indentation in the upper chuck wall, both separately and together. Unmodified can ends were tested by way of control. The results are shown in tables 6 and 7.

The chuck wall indentations comprised a indentation on each side of the tab, set at 90° to the tab. Spacer conditions were as in example 3, but with a 9 mm indent ring spacer (rather than 8.75 mm).

The countersink "trigger" comprised a single bead expansion within the arc of the chuck wall indentation and centered on the same diameter (arc mid-point). This bead expansion was selected to trigger a peak within the chuck wall indentation as identified in example 2.

The control can ends give very low survival figures in both drop tests and seamed end testing (SET), i.e. the control can ends leak when they peak. The chuck wall indentation alone gives good hot drop (100° F.) and SET performance but seems to have higher incidence of score bursts during hot drop testing. The countersink ("c'sk") bead trigger creates a very symmetric end shape from the hot drop test and is very effective in determining the peak location. The countersink trigger reduces the SET performance to 89 psi average, but this is believed to be attributable to the tooling used to create the indentations. In general "1" means yes and "0" means no, except in position in which 1 indicates the position of peak on the control feature.

TABLE 6

(Bruceton staircase comparing unmodified with various modified can ends)

| Unmodified control | | | C'sk bead trigger only | | | | Chuck wall only | | | | Both features | | | |
|---|---|---|---|---|---|---|---|---|---|---|---|---|---|---|
| Height | Leak? | Leak type | Height | Leak? | Position? | Leak Type | Height | Leak? | Position? | Leak Type | Height | Leak? | Position? | Leak Type |
| 5 | y | P | 5 | Y | 1 | p × 2 | 5 | n | 0 | p × 2 | 5 | Y | 1 | clamshell |
| 4 | y | P | 4 | Y | 1 | p × 2 | 5 | y | 1 | p | 4 | N | 1 | p × 2 |
| 3 | y | P | 3 | Y | 1 | p × 2 | 4 | n | 1 | p | 5 | Y | 1 | p × 2 |
| 2 | y | P | 2 | Y | 1 | p × 2 | 5 | n | 1 | p | 4 | N | 1 | p × 2 |
| 1 | y | Score burst | 1 | Y | 1 | score burst | 6 | n | 1 | P | 5 | N | 1 | p × 2 |
| 1 | n | None | 1 | Y | 1 | score burst | 7 | y | 1 | score burst | 6 | Y | 1 | p × 2 |
| 1 | n | P | 1 | N | 1 | score burst | 6 | y | 1 | p × 2 | 5 | N | 1 | p × 2 |
| 2 | y | P | 2 | N | 1 | score burst | 5 | n | 1 | p × 2 | 6 | N | 1 | p × 2 |
| 1 | y | p × 2 | 3 | Y | 1 | p × 2 | 6 | y | 1 | p × 2 | 7 | Y | 1 | p × 2 |
| 1 | y | score burst | 2 | Y | 1 | p × 2 | 5 | n | 1 | p | 6 | Y | 1 | p × 2 |
| 1 | y | P | 1 | Y | 0 | p × 2 | 6 | n | 1 | p × 2 | 5 | N | 1 | p × 2 |
| 1 | n | P | 1 | Y | 1 | score burst | 7 | n | 1 | p × 2 | 6 | N | 1 | p × 2 |
| 2 | n | P | 1 | N | 1 | p × 2 | 8 | n | 1 | p | 7 | Y | 1 | p × 2 |
| 3 | y | p | 2 | Y | 1 | score burst | 9 | n | 1 | score burst | 6 | Y | 1 | p × 2 |
| 2 | n | p × 2 | 1 | N | 0 | p × 2 | 9 | n | 1 | score burst | 5 | N | 1 | p × 2 |
| 3 | y | p | 1 | N | 1 | score burst | 9 | y | 1 | p × 2 | 6 | N | 1 | p × 2 |
| 2 | y | p | 2 | Y | 1 | p × 2 | 8 | n | 1 | p × 2 | 7 | N | 1 | p × 2 |

TABLE 6-continued (Bruceton staircase comparing unmodified with various modified can ends)

| Unmodified control | | | C'sk bead trigger only | | | | Chuck wall only | | | | Both features | | | |
|---|---|---|---|---|---|---|---|---|---|---|---|---|---|---|
| Height | Leak? | Leak type | Height | Leak? | Position? | Leak Type | Height | Leak? | Position? | Leak Type | Height | Leak? | Position? | Leak Type |
| 1 | n | none | 1 | Y | 1 | p × 1 | 9 | y | 1 | score burst | 8 | N | 1 | p × 2 |
| 2 | n | p | 1 | N | 1 | p × 1 | 8 | n | 1 | p × 2 | 9 | Y | 1 | p × 2 |
| 3 | n | p | 2 | Y | 1 | p × 1 | 9 | n | 1 | p × 2 | 8 | Y | 1 | p × 2 |
| 4 | y | p × 2 | 1 | Y | 1 | p × 1 | 10 | y | 1 | p × 2 | 7 | N | 1 | p × 2 |
| 3 | n | p | 1 | Y | 1 | p × 1 | 9 | n | 1 | p × 2 | 8 | N | 1 | p × 2 |
| 4 | N | p | 1 | Y | 1 | score burst | 11 | n | 1 | p × 2 | 9 | Y | 1 | p × 2 |
| 5 | y | p | 1 | Y | 1 | score burst | 12 | n | 1 | p × 2 | 8 | Y | 1 | p × 2 |
| 4 | y | p | 1 | Y | 1 | score burst | 13 | n | 1 | p × 2 | 7 | Y | 1 | clamshell |
| 3 | y | p | 1 | Y | 1 | score burst | 14 | n | 1 | p × 2 | 6 | Y | 1 | P × 2 |
| 2 | y | p × 2 | 1 | Y | 1 | p × 2 | 15 | n | 1 | p × 2 | 5 | N | 1 | P × 2 |
| 1 | y | p × 2 | 1 | Y | 1 | score burst | 15 | y | 1 | p × 2 | 6 | Y | 1 | P × 2 |
| 1 | n | p | 1 | Y | 1 | score burst | 14 | n | 1 | p × 2 | 5 | N | 1 | P × 2 |
| 2 | n | p | | | 93% | | | | 97% | | | | 100% | |

TABLE 7

(SET comparisons of unmodified with modified can ends)

| | Can 1 | Can 2 | Can 3 | Can 4 | Can 5 | Can 6 | Can 7 | Can 8 | Can 9 | Can 10 | Average |
|---|---|---|---|---|---|---|---|---|---|---|---|
| UNMODIFIED | | | | | | | | | | | |
| BUCKLE PRESSURE (psi) | 103.4 | 101.1 | 99.7 | 101.6 | 104.4 | 102.9 | 98.3 | 97.9 | 98.3 | 108 | 102 |
| POSITION? | n/a | n/a | n/a | n/a | n/a | n/a | n/a | n/a | n/a | n/a | n/a |
| SURVIVED? | 1 | 0 | 0 | 0 | 0 | 0 | 0 | 0 | 0 | 1 | 20% |
| OPENS? | 1 | 1 | 1 | 1 | 1 | 0 | 1 | 1 | 1 | 1 | 90% |
| C'sk BEAD TRIGGER DENT ONLY | | | | | | | | | | | |
| BUCKLE PRESSURE (psi) | 88.4 | 91.9 | 92.5 | 91.7 | 91.2 | 91.4 | 91.1 | 92 | 95 | 92.7 | 92 |
| POSITION? | 1 | 1 | 1 | 1 | 1 | 1 | 1 | 1 | 1 | 1 | 100% |
| SURVIVED? | 0 | 0 | 0 | 0 | 0 | 0 | 0 | 0 | 0 | 0 | 0% |
| OPENS? | 1 | 1 | 1 | 1 | 1 | 1 | 1 | 1 | 1 | 1 | 100% |
| CHUCK WALL DENT ONLY | | | | | | | | | | | |
| BUCKLE PRESSURE (psi) | 96.6 | 95.7 | 92.7 | 93.7 | 94.3 | 94.6 | 92 | 95.1 | 93.7 | 95.5 | 94 |
| POSITION? | 1 | 1 | 1 | 1 | 1 | 1 | 1 | 1 | 1 | 1 | 100% |
| SURVIVED? | 1 | 1 | 1 | 1 | 1 | 1 | 1 | 0 | 1 | 1 | 90% |
| OPENS? | 1 | 1 | 1 | 1 | 1 | 1 | 1 | 0 | 1 | 1 | 90% |
| BOTH DENTS | | | | | | | | | | | |
| BUCKLE PRESSURE (psi) | 86.6 | 90.5 | 87.7 | 87.6 | 88.5 | 92.7 | 90.3 | 86.3 | 87.5 | | 89 |
| POSITION? | 1 | 1 | 1 | 1 | 1 | 1 | 1 | 1 | 1 | | 100% |
| SURVIVED? | 1 | 1 | 1 | 1 | 1 | 1 | 1 | 1 | 1 | | 100% |
| OPENS? | 1 | 1 | 1 | 0 | 1 | 1 | 1 | 1 | 1 | | 89% |

EXAMPLE 5

Further seamed end tests were carried out on both unmodified can ends ("control samples") and can ends having a 360° control feature in the form of a shelf in the outer wall of the countersink bead. Results of these trials are given in table 8. Buckle pressure performance was well above the 90 psi industry standard for all cans, both standard and modified. Only 25% of the control samples survived testing without leaking, whereas 100% of the cans having a control feature (circumferential shelf in the countersink bead) passed the test without leaking.

TABLE 8

| Control Samples | | Shelf in Bead | |
|---|---|---|---|
| Buckle Pressure (psi) | | Buckle Pressure (psi) | Leak |
| 102.6 | n | 98.1 | n |
| 102.3 | n | 104.1 | n |
| 105.6 | y | 102.3 | n |
| 105.6 | y | 96.8 | n |
| 101.5 | n | 103.4 | n |
| 101.7 | y | 103.5 | n |
| 102.5 | y | 104 | n |
| 104.6 | y | 103.5 | n |
| 107 | n | 99.8 | n |

TABLE 8-continued

| Control Samples | | Shelf in Bead | |
|---|---|---|---|
| Buckle Pressure (psi) | | Buckle Pressure (psi) | Leak |
| 103.4 | y | 105 | n |
| 103.5 | y | 103.6 | n |
| 104.2 | y | 104.1 | n |
| 103.6 | n | 103.9 | n |
| 102.2 | n | 104 | n |
| 103 | n | 102.2 | n |
| 103 | y | 103.1 | n |
| 103.5 | y | 105.5 | n |
| 105.1 | y | 104.5 | n |
| 102.8 | y | 101.9 | n |
| 102.8 | y | 104.1 | n |
| 104.7 | y | 100.5 | n |
| 103.8 | y | 103.2 | n |
| 103.8 | y | 102.3 | n |
| 105.9 | y | 101.9 | n |
| 104.5 | y | 105.7 | n |
| 103.3 | y | 105.6 | n |
| 103.3 | y | 98.6 | n |
| 104.5 | y | 101.3 | n |

As set forth in the Background section, although when subjected to severe abuse conditions can ends described in the 634 patent having a wall inclined at less than 45° will fail at a pressure greater than that of a conventional end, the mode of failure will be such that the bead will very locally peak, potentially resulting in fracturing and leaking—a situation referred to as "peak and leak." The inventors have determined that such an end tends to fracture at the peak when the end fails by the countersink bead collapsing or folding in on itself in response to sufficient internal pressure. The end shown in the Figures of the 634 patent experienced the peak and leak failure mode at least in part because its high hoop strength or "locking" resisted failure by other modes, such as seaming unravelling.

In addition to the control features described above, the inventors have found that increasing the wall angle to 46° or more tends to diminish the formation of the peak and leak failure mode. In this regard, the inventors believe that the inventive seamed end is weakened such that it tends to fail in a manner that is not as localized as that described above and that promotes less localized bead eversion. The inventors have further found that incorporating a weakening in the countersink bead outer wall of the end, in addition to the increased wall angle inclination, enhances the controlled and non-catastrophic manner in which the end fails.

EXAMPLE 6

Figure 6:
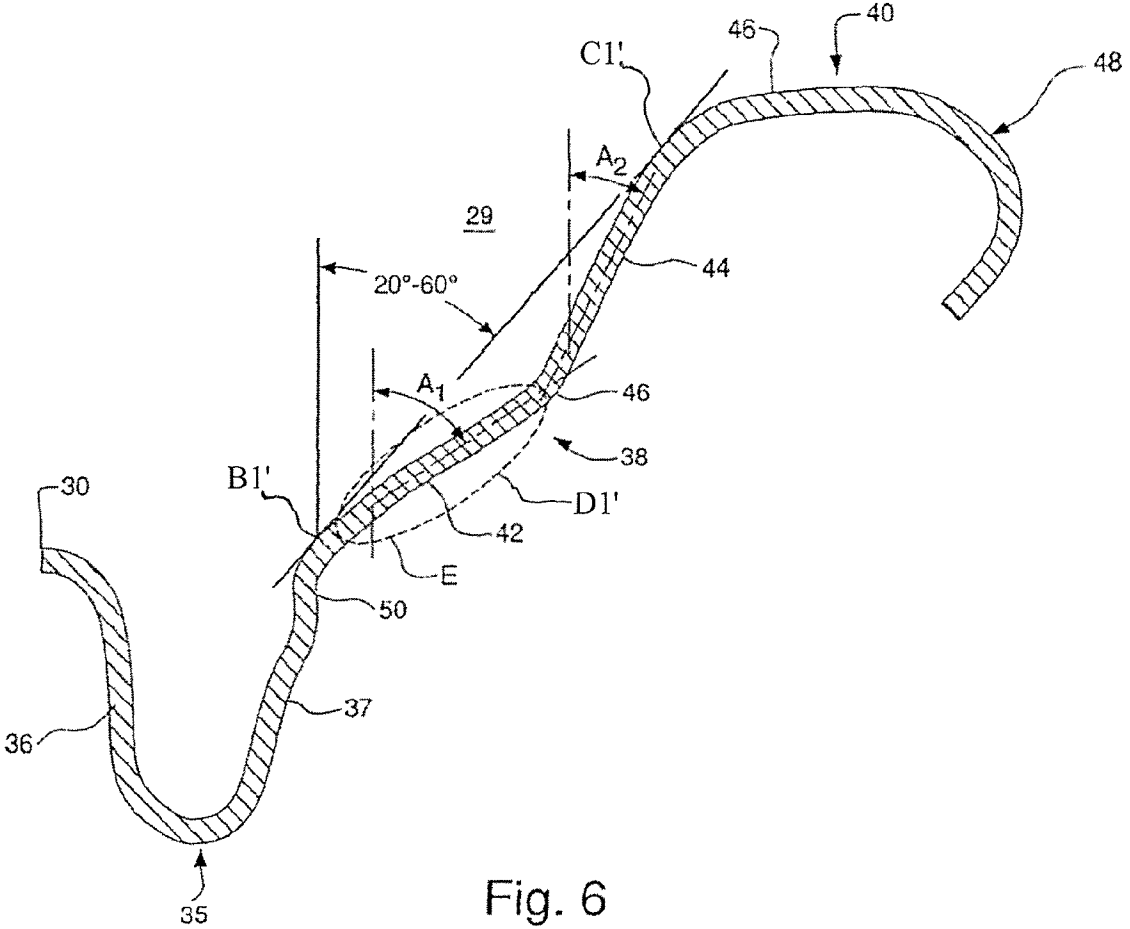
FIG. 6 is a cross-sectional view of an unseamed can end illustrating another embodiment of the present invention.

FIG. 6 shows an embodiment that illustrates the present invention. An unseamed can end 29 includes a center panel 30, a reinforcing bead 35 extending outwardly from center panel 30, a wall 38 extending outwardly from the reinforcing bead 35, and a peripheral curl 40 extending outwardly from wall 38. Reinforcing bead 35 includes inner sidewall 36 and outer sidewall 37 with a bottom portion 38 therebetween. The bottom portion 38 may be formed of any shape, and preferably includes at least one curve.

Peripheral curl 40 includes a radiused portion 45 that merges into chuck wall upper portion 44, a seaming panel 47, and a peripheral cover hook 48 suitable for forming a double seam with a can body. As previously discussed, the reinforcing bead 35 preferably includes a weakening in the bead that increases the circumferential extent of the eversion of the bead at failure, thereby preventing the peak and leak condition. As also previously discussed, such a weakening can be in the form of a coined and/or expanded section of the bead. The expansion of the bead may be in the form of an increase in the diameter of only a portion of the height of the bead outer wall, which can be done around the entire circumference or over only a portion of the circumference, or an increase in the diameter of the bead outer wall over its entire height but only around a portion of its circumference. In the embodiment shown in FIG. 6, the weakening is in the form of an expanded portion 50 in which the diameter of the upper portion of the bead outer wall is increased around its entire circumference. Preferably, the vertical depth of the expanded portion is in the range of is in the range of 0.370 to 0.390 inch, and most preferably approximately 0.385 inches, while the increase in the diameter is preferably in the range of 0.026 inches to 0.043 inches, and most preferably approximately 0.033 inches.

Wall 38 includes a lower portion 42, an upper portion 44, and a juncture 46 therebetween. Juncture 46 encompasses any transition, such as a sharp transition between upper and lower wall portions or a radiused portion interposed therebetween. A point B1' is defined as the transition between bead outer wall 37 and lower portion 42 of chuck wall 38. A point C1' is defined as the transition between chuck wall 38 and peripheral curl 40.

Chuck wall lower portion 42 preferably is substantially straight and sloped such that its axis forms an angle A1 with a vertical axis of, preferably, between 46° and 54°, more preferably between 48° and 54°, and most preferably 52°, as demonstrated by the data provided in Tables 9-13. The upper limit on angle A1 will depend on the diameter and depth of center panel, bead configuration and dimensions, end thickness, and like practical parameters. The inventors estimate that 60° is an effective upper practical limit of angle A1.

Wall upper portion 44 preferably is substantially straight and sloped such that its axis forms an angle A2 with respect to a vertical axis of that is less than angle A1, and preferably less than about 44°, and more preferably approximately 28°. Such angle A2 promotes alignment of the can end onto the can body in the seamer and aids in the material deformation that occurs in the first seaming operation. The magnitude of angles A1 and A2 preferably may be chosen such that a line between point B1' and point C1' forms an angle of between 20° and 60°, more preferably between 30° and 55°, even more preferably between 40°and 50, and most preferably approximately 43°.

The present invention is not limited to walls 42 and 44 that are straight, but rather encompasses walls that are convex when viewed from above. FIG. 6 schematically illustrates a centerline of a convex lower wall at D1'. For a curved lower wall, the angle A1 may be measured between points B1' and juncture 46.

Figure 8:
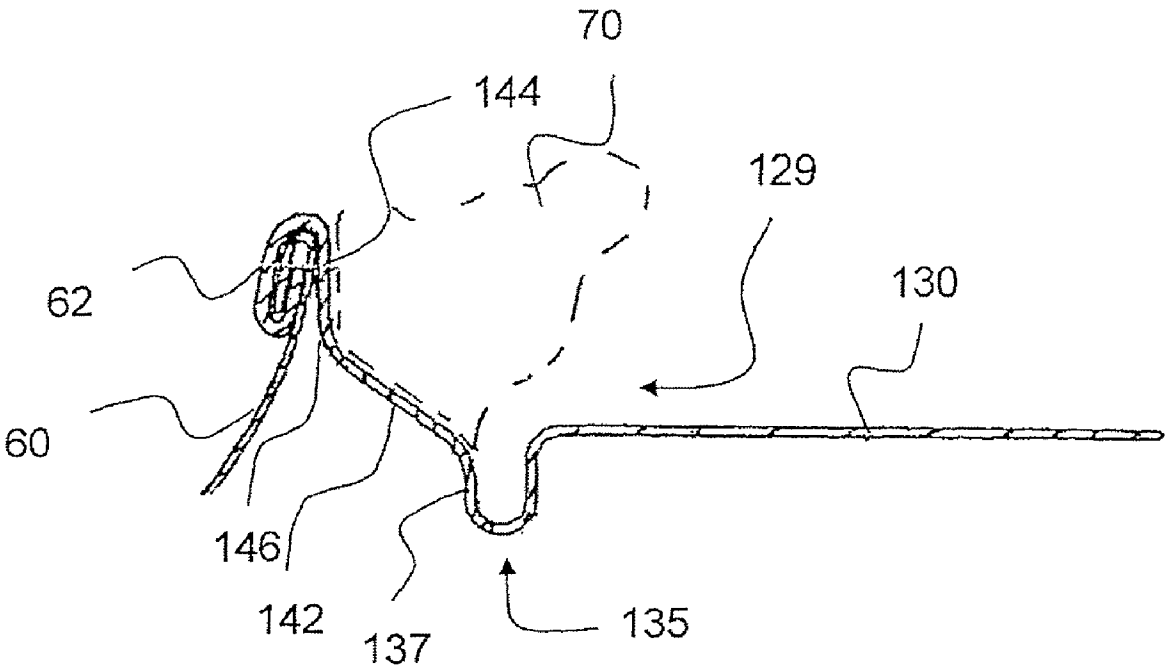
FIG. 8 is a cross-sectional view of the can end of FIG. 7 that has been seamed onto a container.

Table 9 shows the inclination A1 of lower wall portion 42 of the can end, the tool angle used in the shell press that forms the lower wall portion 42, and the corresponding angle of the preferred seaming chuck, shown in phantom in FIG. 8, used to seam the can onto the end. The ends on which the data in Tables 9 through 13 are based also includes an expansion 50 on the upper portion of the bead outer wall 37 extending 360° around the end and approximately 0.385 inches axially deep and approximately 0.0165 in radial dimension, as shown in FIG. 6. The ends were formed of 0.082 inch aluminium.

Table 10 provides drop test results and failure modes for the end shown in FIG. 6 that is seamed onto a can end. The seam is shown in FIG. 8. Percentages are shown in parenthesis. The term "score burst" refers to rupture of the score. The term "vent" refers to a pin hole or slight fracture at the score that depressurizes the can, but is not a fracture of sufficient magnitude to be characterized as a burst. Reference J-3 is identical to reference J except its bead wall expansion is 0.003 inches smaller in penetration or vertical magnitude. Each can was pressurized to approximately 60 psi by injection of approximately four volumes of carbon dioxide into water, and temperatures of between 69° F. and 73° F. were chosen for the cans to equalize the small differences in pressurization such that the internal pressure of the cans was 60 psi.

TABLE 9

| (degrees) | | | | |
|---|---|---|---|---|
| End Pack Code | tool angle | end angle (A1) | seaming chuck | quantity carb water |
| D | 51.5 | 48 | 51 | 150 |
| E | 57.2 | 54 | 54 | 150 |
| H | 55 | 52 | 54 | 150 |
| J | 53.5 | 50 | 51 | 150 |
| J-.003 | 53.5 | 50 | 51 | 150 |

TABLE 10

| Drop Test (42") | | | | | |
|---|---|---|---|---|---|
| drop test | D (48) | E (54) | H (52) | J (50) | J-.003 |
| peak no leak | 0 | 13 (26) | 17 (29) | 3 (4) | 4 (7) |
| peak and score burst | 64 (100) | 37 (74) | 39 (67) | 66 (94) | 57 (93) |
| peak and vent | 0 | 0 | 2 (3) | 1 (1) | 0 |
| Total tested | 64 | 50 | 58 | 70 | 61 |

None of the samples provided in Table 10 had leaking at the peak. For comparison, the drop test results for ends having a wall inclined at 43.5°, without control features described herein, yielded 6 ends that leaked on the peak (12.5%), 36 ends that leaked on the peak and also burst at the score (75%), and 6 ends that peaked but did not otherwise leak (12.5%) out of 48 ends. Table 6 provides data for seamed ends having a wall that is inclined at 43.5°, unmodified by the teachings herein, which are heated to 100° F. such that their internal pressure is approximately 85 psi. The results of Table 6 may be generally compared to the results of Table 10 because the hot cans of Table 6 are dropped from a lower height than the cans of Table 10.

The end designated by reference H, having a wall angle of 52°, shows a somewhat higher percentage of ends that peak but do not leak and, thus, a lower percentage of ends that burst or vent at the score compared with the other ends.

Table 11 provides the numbers and percentages for each type of failure mode during a heating test, in which seamed cans were laid on their sides and heated to 130° F. for two to three hours. As shown below, leaking at the peak occurred only once for any of the cans tested.

TABLE 11

| Heating Test | | | | | |
|---|---|---|---|---|---|
| Failure Mode | D | E | H | J | J-.003 |
| Peak no Leak | 56 (81) | 76 (88) | 52 (83) | 67 (92) | 59 (88) |
| Seam Weep | 10 (14) | 9 (10) | 10 (16) | 2 (3) | 7 (10) |
| Peak and Leak | 0 | 0 | 0 | 1 (1) | 0 |
| Peak no Leak, Score Burst | 3 (4) | 1 (1) | 1 (2) | 3 (4) | 1 (1) |
| Totals | 69 | 86 | 63 | 73 | 67 |

For comparison, a heating test of 48 cans having ends with a wall inclined to 43.5° without a weakening or control feature described herein produced 30 failed by seam unravelling (and, thus, leaking) and 18 failed by the peak and leak failure mode.

Table 12 provides the pressure at which the unseamed, non-aged can ends failed in an Altek tester. To simulate the hoop strength of the seamed can end, the Altek tester was modified to constrain radial movement of the end. The failure mode is also provided. In Table 12, "L" refers to a leak at the peak. Table 13 provides pressure test data for a seamed can end.

TABLE 12

| (psi) | | | | | | | | | |
|---|---|---|---|---|---|---|---|---|---|
| D 48° | | E 54° | | H 52° | | J 50° | | J-.003 50° | |
| 101.8 | L | 97.8 | No L | 98.0 | No L | 99.2 | No L | 102.3 | No L |
| 103 | L | 98.3 | No L | 97.6 | No L | 100.7 | No L + SB | 100.0 | No L |
| 103.1 | L | 99.8 | No L | 98.5 | No L | 98.6 | No L | 102.2 | No L |
| 102.3 | No L | 99 | No L | 99.5 | No L | 101.3 | No L | 99.5 | No L |
| 99.8 | L | 98.4 | No L | 97.9 | No L | 98.5 | No L | 101.1 | No L |
| 101.3 | L | 99.4 | No L | 98.3 | No L | 100.2 | No L | 98.3 | L |
| 100.4 | L | 98.6 | No L | 99.1 | No L | 101.1 | No L | 99.2 | No L |
| 99.8 | L | 98.8 | No L | 98.9 | No L | 101.0 | No L | 101.0 | No L |
| 102.7 | L | 99.3 | No L | 98.2 | No L | 100.2 | No L | 99.9 | No L |
| 102 | L | 98.5 | No L | 99.0 | No L | 101.3 | No L | 99.8 | No L |
| 100.7 | L | 97.3 | No L | 100.2 | No L | 98.9 | No L | 100.0 | L |
| 102.3 | L | 97.1 | No L | 99.7 | No L | 99.0 | No L | 99.4 | No L |
| 101.7 | L | 98.3 | No L | 98.7 | No L | 99.4 | No L | 99.0 | No L |
| 100.2 | L | 97 | No L | 99.3 | No L | 99.5 | No L | 99.3 | No L |
| 99.7 | L | 97.9 | No L | 99.2 | No L + SB | 100.6 | No L | 99.9 | No L |
| 101 | L | 97.9 | No L | 99.2 | No L | 97.4 | No L | 99.8 | No L |
| 100.5 | L | 97.6 | No L | 98.9 | No L | 100.4 | No L | 100.0 | No L |

TABLE 12-continued

| (psi) | | | | | | | | | |
|---|---|---|---|---|---|---|---|---|---|
| D 48° | | E 54° | | H 52° | | J 50° | | J-.003 50° | |
| 100.5 | L | 97.8 | No L | 98.2 | No L | 101.1 | No L + SB | 99.3 | No L |
| 103.1 | L | 97.3 | No L | 97.9 | No L | 98.6 | No L | 99.9 | No L |
| 100.5 | L | 99.1 | No L | 100.0 | No L | 99.1 | No L | 99.8 | No L |
| 101.3 | L + SB | 98.8 | No L | 99.0 | No L | 99.9 | No L | 102.1 | No L |
| 99.4 | L | 97.6 | No L | 100.6 | No L | 100.2 | No L + SB | 99.4 | No L |
| 98.4 | L | 98.1 | No L | 97.3 | No L | 99.0 | No L | 99.6 | No L |
| 100.2 | L | 99.4 | No L | 98.4 | No L | 99.6 | No L | 98.7 | L |
| 101.7 | No L | 97.6 | No L | 99.0 | No L | 98.2 | No L | 99.2 | L |
| 101.9 | L | 98.1 | No L | 98.3 | No L | 99.9 | No L | 99.2 | No L |
| 101.1 | L | 98 | No L | 100.2 | No L + SB | 100.0 | No L | 99.8 | L |
| 100.9 | L | 98.2 | No L | 98.1 | No L | 100.1 | No L + SB | 102.2 | No L |
| Averages/No. Not Leaking | | | | | | | | | |
| 101.1 | 2 | 98.3 | 28 | 98.8 | 28 | 99.8 | 28 | 100.0 | 23 |

TABLE 13

| Seamed End Pressure Data | | | | | | | | | |
|---|---|---|---|---|---|---|---|---|---|
| D 48° | | E 54° | | H 52° | | J 50° | | J-.003 50° | |
| 91.3 | | 85.3 | | 86.9 | V | 91.8 | SB | 89.2 | V |
| 91 | | 85.1 | V | 88 | | 89.9 | V | 90.1 | V |
| 90.9 | | 85 | | 89.1 | V | 90.7 | V | 89.9 | V |
| 92 | SB | 83 | V | 87 | V | 89.7 | | 89.1 | V |
| 92.2 | SB | 86.1 | V | 88.6 | | 90.1 | V | 89.4 | V |
| 92.3 | V | 86.2 | V | 89.5 | | 89.4 | | 90.2 | V |
| 90.1 | SB | 84.8 | V | 88.1 | | 89.8 | V | 89.9 | V |
| 89.9 | SB | 86.4 | V | 86.2 | | 91.1 | SB | 88.6 | V |
| 91.5 | V | 85 | V | 89.3 | V | 89.8 | V | 89 | V |
| 91.9 | SB | 82.9 | V | 88.4 | V | 90 | V | 90.3 | V |
| Averages/No Venting or Score Burst | | | | | | | | | |
| 91.3 | 3 | 85.0 | 2 | 88.1 | 5 | 90.2 | 3 | 89.6 | 0 |

As shown in Table 12 and Table 13, increasing the wall angle decreases the seamed strength of both the unseamed and seamed ends. The improved properties relating to leaking are apparent.

EXAMPLE 7

Figure 7:
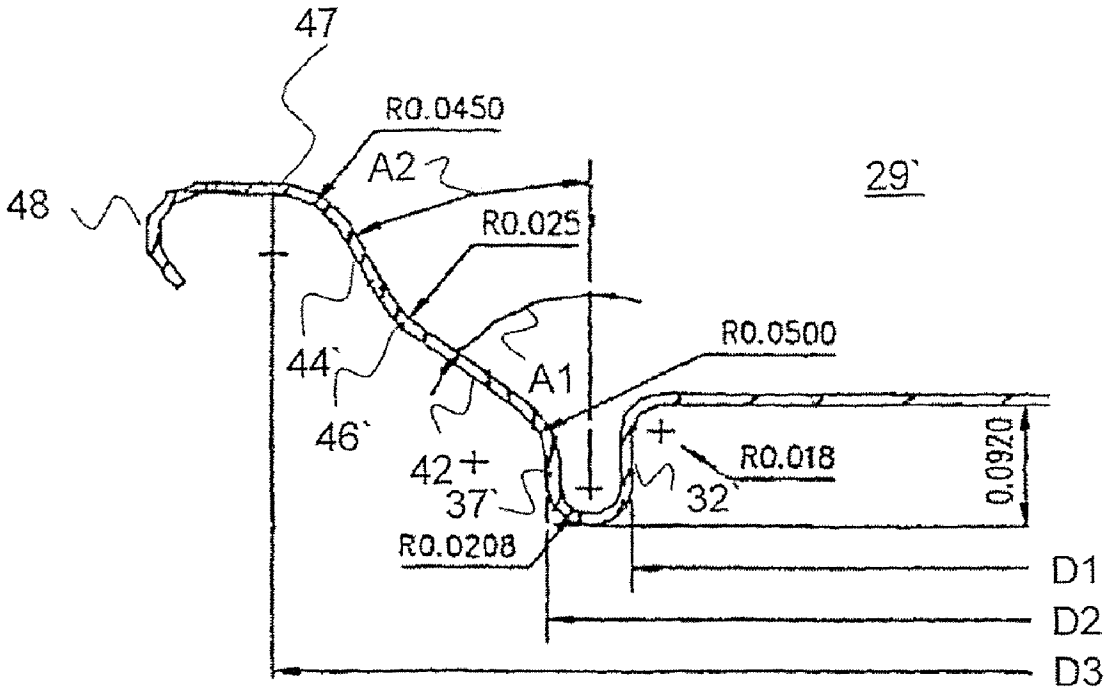
FIG. 7 is a cross-sectional view of another embodiment of the unseamed can end.

Referring to FIG. 7 to illustrate another embodiment of the present invention, a unseamed can end 29' is identical to end 29 of FIG. 6 except bead 35' does not have an expanded outer wall. The components of end 29' are shown with a prime designation to indicate their correspondence with like components of the embodiment of FIG. 6. For a 202 size can end, dimension D1 is 1.688 inches; D2 is 1.804 inches, and D3 is 2.169 inches. FIG. 7 provides other preferred dimensional information merely to illustrate the embodiment for a size 202 can end, but such dimensional information is not intended to limit the scope of the invention unless expressly set forth in the claims.

Unseamed end 29', that is, without an expansion of countersink bead 35 or other additional weakening feature, provides improved fracture resistance, when seamed onto a can body, upon failing compared with seamed ends having a wall inclined to 43.5 degrees. For example, no cans formed with an end 29' leaked in a heating test.

Table 14 provides the failure modes by percent of ends 29' having an angle A1 of 52° in a drop test. The cans were pressurized to 55 psi. Seven percent of the seamed ends leaked at the peak.

TABLE 14

| Peak no Leak | Score Burst on Buckle | Score path pinhole | Vent | Peak and Leak |
|---|---|---|---|---|
| 30 | 52 | 2 | 9 | 7 |

Also, the unseamed can end 29' withstood 100.4 psi and the seamed end withstood 84.6 psi.

The inventors estimate that wall angles of 46° or more, with or without a bead expansion 50, will weaken the seamed end for reasons relating to resolving the component vectors of the force transmitted through the wall to the seam, as described more fully above. Accordingly, the present invention encompasses an end having a wall inclined at an angle A1 equal to or greater than 46° and preferably below 60°, preferably in between approximately 48° and approximately 54°, and most preferably approximately 52°. The inventors believe that the conclusions of Tables 9 through 13 apply to end 29' shown in FIG. 7.

Preferred ranges of angle A1 are provided for the ends shown in FIGS. 6 and 7. The range of angles A1 from 46° to 60° takes into consideration the strength and rigidity of ends of other configurations such that the range covers walls that enable the bead to unravel before the bead collapses, which provides the improved failure mode discussed herein.

FIG. 8 illustrates a seamed can that includes a can body 60 and an end 129 seamed thereto. A seam 62 is formed by portions of the can body 60 and end 129. End 129 includes a center panel 130, a reinforcing bead 135 having an outer wall 137, and an inclined wall 142. A portion 144, which corresponds to upper wall portions 44 and 44' of the unseamed can ends 29 and 29', respectively, of end 129 forms a portion of seam 62.

A portion of chuck 70 is shown in FIG. 8. Chuck 70 includes a chuck wall 72 that is inclined as indicated in Table 9.

The invention has been described above by way of example only and numerous changes and/or permutations may be made within the scope of the invention as filed. It should also be noted that the control features of the invention are particularly intended for use on beverage can ends which are to be fixed to a can body and thereby subjected to internal pressure. Furthermore, the control features may be used on can ends having any chuck wall angle whether conventional (less than 15°) or larger, such as that of the '634 patent, i.e. 30° to 60°.

The invention claimed is:

1. A can end shell comprising:

a circular center panel;

a countersink bead having an inner wall and an outer wall joined by a generally curved bottom portion;

a flattened strain limiting shoulder for triggering peaking joining the inner wall of the countersink bead to the center panel, the flattened shoulder extending around a 360 degree arc;

a multipart chuck wall portion extending up from the outer wall of the countersink, at least one part of the chuckwall being curved in cross section; and a seaming panel extending from the chuck wall portion.

2. The can end shell of claim 1, wherein the flattened shoulder is coined.

3. The can of claim 1, wherein the can end shell further comprises an indentation positioned at least partially in the upper half of the chuck wall, the indentation extending either internally or externally, or a combination of these.

4. A can end shell for seaming onto a can body, the can end shell comprising:

a circular center panel;

a countersink bead having an inner wall and an outer wall joined by a generally curved bottom portion;

a flattened strain limiting shoulder for triggering peaking joining the inner wall of the countersink bead to the center panel, the flattened shoulder extending around a 360 degree arc;

a chuck wall portion located radially outwardly from the countersink, the chuck wall portion including a radially externally oriented indentation that is located at a point on the chuck wall that is proximate to a root of the seam upon seaming of the can end shell onto a can body; and a seaming panel located radially outwardly from the chuck wall.

5. The can end shell of claim 4, wherein the indentation is positioned at approximately a half way point of the chuck-wall.

6. The can end shell of claim 4, wherein the externally oriented indentation is located in the upper half of the chuck wall.

7. The can end shell of claim 4, wherein the flattened shoulder is coined.

8. The can end shell of claim 4, wherein the indentation extends around a 360 degree arc.

9. A can end shell for seaming onto a can body, the can end shell comprising:

a circular center panel, a countersink bead having an inner wall and an outer wall joined by a generally curved bottom portion;

a flattened strain limiting shoulder for triggering peaking joining the inner wall of the countersink bead to the center panel, the flattened shoulder extending around a 360 degree arc;

a chuck wall portion located radially outwardly from the countersink, the chuck wall portion including a radially externally oriented indentation that is located at approximately a half way point of the chuckwall; and a seaming panel located radially outwardly from the chuck wall.

10. The can end shell of claim 9, wherein the flattened shoulder is coined.

11. The can end shell of claim 9, wherein the indentation extends around a 360 degree arc.

* * * * *